US008397995B2

(12) United States Patent
Camus

(10) Patent No.: US 8,397,995 B2
(45) Date of Patent: Mar. 19, 2013

(54) SECURITY STRUCTURE INCLUDING NEMATIC LIQUID CRYSTALS

(75) Inventor: Michel Camus, Rives sur Fure (FR)

(73) Assignee: Arjowiggins Security, Paris (FR)

( * ) Notice: Subject to any disclaimer, the term of this patent is extended or adjusted under 35 U.S.C. 154(b) by 188 days.

(21) Appl. No.: 12/746,013

(22) PCT Filed: Dec. 17, 2008

(86) PCT No.: PCT/FR2008/052335

§ 371 (c)(1),
(2), (4) Date: Jun. 21, 2010

(87) PCT Pub. No.: WO2009/081035

PCT Pub. Date: Jul. 2, 2009

(65) Prior Publication Data

US 2010/0276488 A1 Nov. 4, 2010

(30) Foreign Application Priority Data

Dec. 24, 2007 (FR) ..... 07 60336

(51) Int. Cl.
*G06K 19/02* (2006.01)
*G06K 19/00* (2006.01)

(52) U.S. Cl. ..... 235/488; 235/487

(58) Field of Classification Search ..... 235/487, 235/488

See application file for complete search history.

(56) References Cited

U.S. PATENT DOCUMENTS

| | | | | |
|---|---|---|---|---|
| 6,402,888 | B1 | 6/2002 | Doublet et al. | |
| 6,764,014 | B2 * | 7/2004 | Lasch et al. | 235/487 |
| 2008/0106725 | A1 | 5/2008 | Schuetzmann et al. | |

FOREIGN PATENT DOCUMENTS

| | | | |
|---|---|---|---|
| EP | 0 229 645 | A1 | 7/1987 |
| EP | 0 549 284 | A1 | 6/1993 |
| EP | 1 120 737 | A1 | 8/2001 |
| EP | 1 335 217 | A2 | 8/2003 |
| GB | 2 306 178 | A | 4/1997 |
| WO | WO 94/20679 | A1 | 9/1994 |
| WO | WO 96/06220 | A1 | 2/1996 |
| WO | WO 02/085642 | A2 | 10/2002 |
| WO | WO 2004/025337 | A1 | 3/2004 |
| WO | WO 2005/005727 | A1 | 1/2005 |

OTHER PUBLICATIONS

Written Opinion of the International Searching Authority dated Aug. 20, 2009 in International Patent Application No. PCT/FR2008/052335.

Aug. 20, 2009 International Search Report issued in corresponding International Patent Application No. PCT/FR2008/052335 (with translation).

* cited by examiner

*Primary Examiner* — Jamara Franklin
(74) *Attorney, Agent, or Firm* — Oliff & Berridge, PLC

(57) ABSTRACT

A security structure including: a first region that is at least partially reflective and of low opacity; a second region that is at least partially reflective and of higher opacity than the first region; and a layer of a coating presenting birefringence properties, covering the first and second regions, at least in part.

20 Claims, 1 Drawing Sheet

Fig.1
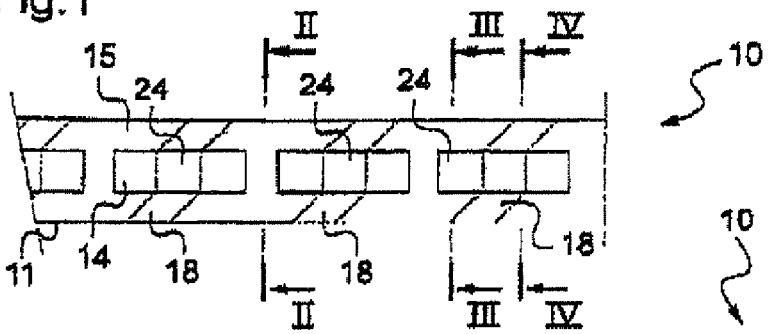
Fig.2
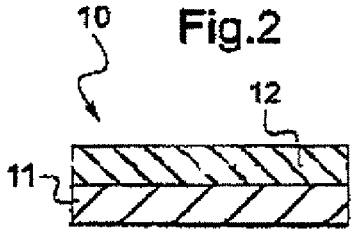
Fig.3
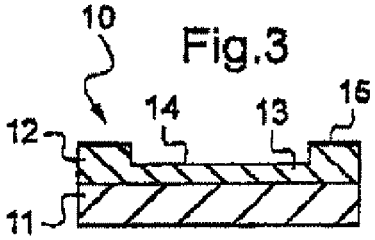
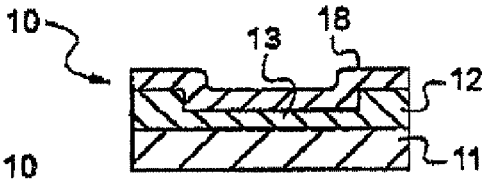
Fig.4
Fig.5
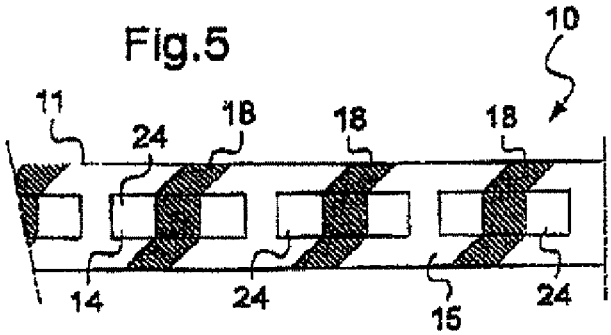
Fig.6
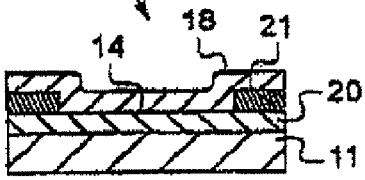
Fig.7
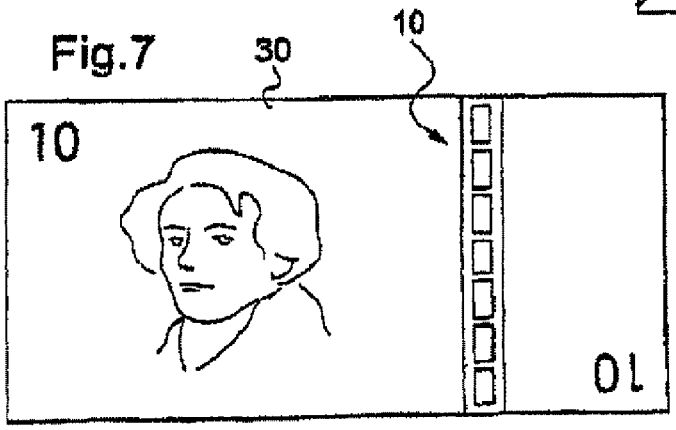
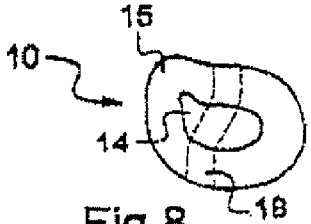
Fig.8

SECURITY STRUCTURE INCLUDING NEMATIC LIQUID CRYSTALS

The present invention relates to security structures for incorporating in articles that need to be made secure, e.g. documents of value such as bank notes, tickets, or coupons, packaging, or security documents such as passports or identity cards, for example.

It is known to introduce security threads into papers, where such threads comprise a medium of plastics material, e.g. of polyester, coated in a deposit of metal, which deposit is removed in part so as to form text that is visible in transmitted light.

It is also known to use coatings that present birefringence properties, e.g. including so-called "nematic" liquid crystals.

Application WO 02/085642 describes the use in security structures of a coating presenting birefringence properties and possibly including nematic liquid crystals.

There exists a need to benefit from novel security structures of greater complexity, that provide increased security.

Thus, in one of its aspects, the invention provides a security structure comprising:

- a first region that is at least partially reflective and of low opacity;
- a second region that is at least partially reflective and of higher opacity than the first region; and
- a coating presenting birefringence properties, e.g. including nematic liquid crystals, and covering the first and second regions, at least in part. The coating may be deposited by a printing technique.

The invention offers novel effects by using said coating, advantageously of nematic liquid crystals, overlying regions of varying opacity.

This variation in opacity enables the coating to be observed differently, in particular a nematic liquid crystal coating, depending on whether the coating covers the first region of low opacity or the second region of higher opacity.

The term "at least partially reflective" should be understood as specular type reflection being observed, as opposed to diffuse reflection.

The specular reflection may be stronger or weaker depending on the viewing angle.

The reflective quality and the limit of specular reflection may be selected in such a manner as to obtain sufficient visibility of the liquid crystals through a polarizing filter.

In an embodiment, the first region of low opacity is semi-reflective, like a semi-silvered mirror, while the second region of higher opacity is reflective. In reflection, the first and second regions both appear to be reflective, thereby contributing to making visible the pattern(s) formed by the coating, in particular the layer of nematic liquid crystals; there is no need for these patterns to be positioned accurately relative to the first and second regions in order to ensure that they are properly visible, contrary to what would be necessary, for example, if nematic liquid crystals were printed on a structure comprising metallized zones that are reflective and demetallized zones that are transparent.

By way of example, the first and second regions may be obtained by depositing varying thicknesses of a metal, e.g. of aluminum.

In another embodiment, the structure includes a deposit of a first material defining the first region of low opacity, being covered in a deposit of a second material in the second region of higher opacity.

The second region of higher opacity may completely surround the first region.

The first region may define patterns that repeat at optionally regular intervals, the first patterns defining windows and/or text.

The difference in opacity between the first and second regions, when the structure is observed in transmitted light, may depend on the way in which the first and second regions are made, with this difference in opacity being adjusted so as to ensure that it provides contrast that is easily visible when viewed in transmitted daylight.

In particular when the patterns are made by association with at least one aluminum-based reflective layer, the difference in opacity between the region of low opacity and the region of higher opacity, as measured using a spectrophotometer (paper backing standard: ISO 2471), may lie in the range 5 to 80 units, and preferably in the range 35 to 40 units.

Other techniques for obtaining material presenting reflective power while being transparent or of low opacity, are known to the person skilled in the art, e.g. using materials that present a large difference of refractive index relative to an associated medium (e.g. a film of a polyester type polymer). Materials of this kind are well known, e.g. when providing transparent holographic security. For example, metal salts may be used having a general formula of the type TiO, or such as zinc sulfide (ZnS). It is also possible to use iridescent pigments of the "Iriodin" type (produced by the supplier Merck), it being understood that the opacity depends on the quantity of pigments deposited.

The coating, in particular the layer of nematic liquid crystals, may form at least one pattern, e.g. a plurality of patterns that repeat on the structure. By way of example, the coating may include nematic liquid crystal printing in the form of at least one pattern. By way of example, these patterns may define text or a logo or simple geometric shapes, and they may also be in varying positions relative to the zone(s) of low opacity.

In another of its aspects, the invention also provides an article, in particular a document, that incorporates a security structure as defined above.

By way of example, the security structure may form a security thread that extends from one side to the other of the document.

The document may include a fiber substrate, e.g. a substrate of papermaking fibers.

The invention also provides a method of authenticating a security structure as defined above, the method comprising the following steps:

- observing the structure in reflection, in particular in non-polarized light, the observation being performed without a polarizing filter, in particular without a filter presenting linear and/or circular polarization; and
- observing the structure in reflection through a polarizing filter. Where appropriate, the method may also include the step that consists in observing the structure in transmitted light.

It may be decided that the structure is authentic by using a polarizing filter to observe the birefringent coating, in particular liquid crystals, and seeing that the regions of the coating that overlie the zones of low opacity contrast with the regions overlying the zones of high opacity.

It may also be concluded that the structure is authentic if the liquid crystals are not visible in transmitted light and only the patterns formed by the regions of different opacities can be observed.

Authentication may be performed with the naked eye, in light that is visible or invisible, in particular ultraviolet (UV) or infrared (IR) light, that is natural or artificial, and with or without using magnification.

The invention can be better understood on reading the following detailed description of non-limiting embodiments thereof, and on examining the accompanying drawing, in which:

FIG. 1 is a diagrammatic face view of an example security structure of the invention;

FIG. 2 is a cross-section on II-II of FIG. 1;

FIG. 3 is a cross-section on III-III of FIG. 1;

FIG. 4 is a cross-section on IV-IV of FIG. 1;

FIG. 5 shows the FIG. 1 structure in observation conditions that make the nematic liquid crystals observable;

FIG. 6 is a view analogous to FIG. 4 showing a variant embodiment;

FIG. 7 shows a document incorporating a security structure of the invention; and FIG. 8 is a diagrammatic plan view of a variant embodiment of the security structure.

In the figures, the real proportions of the various elements shown are not always complied with, for reasons of clarity in the drawings.

The structure 10 shown in FIGS. 1 to 5 comprises a transparent or translucent medium 11, e.g. made of thermoplastic film, e.g. of polyester, polyvinylchloride (PVC), polypropylene (PP), an aromatic or aramid polyamide, etc., and on the medium, further comprises a deposit 12 of a metal, an alloy, or a metallic oxide, e.g. of aluminum, copper, zinc, gold, platinum, . . . .

In the example under consideration, the deposit 12 is of varying thickness, thus defining a first region 14 of smaller thickness and reduced opacity and a second region 15 of greater thickness and increased opacity.

The thickness of the thin layer 13 defining the first region 14 is selected so as to confer on the structure, in said region 14, a characteristic of being semi-reflecting or reflecting depending on the angle of observation, i.e. having a reflecting characteristic that varies as a function of the angle of observation but for which the proportion of light reflected is less than 100%, while the thickness of the deposit 12 in the second region 15 confers an opaque reflecting characteristic on the structure in said second region.

By way of indication, the thickness of the thin layer 13 lies for example in the range 5 nanometers (nm) to 50 nm, and the thickness of the deposit 12 in the second region 15 lies for example in the range 100 nm to 300 nm.

The first region 14 may appear in various ways on the structure, for example in the form of "windows" 24 that repeat at regular intervals along the structure 10, as shown. The first region 14 may also form at least one text or logo.

In the example under consideration, the second region 15 completely surrounds the first region 14, however that is not essential and the first region 14 could in particular extend to at least one of the longitudinal edges of the structure 10.

The structure 10 also includes a coating of a birefringent material, specifically a layer of nematic liquid crystals, in the form of patterns 18 that repeat at regular intervals along the structure and of predefined positioning relative to the first region 14, such that the patterns 18 cover both the first region 14 and the second region 15.

By way of example, the nematic liquid crystals used are those produced by the supplier Merck, adapted to conventional printing techniques, as disclosed in application WO 2004/025337.

When the structure 10 is observed in transmitted light, the nematic liquid crystals are not apparent, and only the patterns 24 are observed contrasting with the second opaque region 15.

When the structure 10 is observed in reflected light, through a filter presenting linear and/or circular polarization, the patterns 18 appear on a background that appears to be substantially solid, since the patterns 24 reflect light and do not appear, or appear little, substantially matching the second region 15 that is likewise reflecting. The zones of low opacity may present reflecting power that is different from the zones of high opacity, and the nematic liquid crystals may also present observation contrast that differs perceptibly with the zones when seen through the polarizing filter.

The invention is not limited to any particular way of obtaining the first and second regions, and by way of example, as shown in FIG. 6, it is possible to deposit a first reflecting material 20 on the medium 11, the first reflecting material presenting opacity that is sufficiently low to define the first region 14, and to deposit a second reflecting material 21 on the first material 20 at the locations presenting higher opacity.

By way of example, the first material is a metal such as aluminum and the second material is a vacuum-deposited oxide, such as $TiO_x$, or ZnS, for example.

The security structure 10 may be in the form of a security thread, e.g. that is incorporated in a document 30, which document comprises, by way of example, a fiber substrate, with the thread being incorporated by any conventional technique for incorporating a security thread.

The security structure 10 may be placed so that its entire length is on the surface of the document 30, or it may be partially buried within the fiber substrate.

The document 30 may include other security elements, such as a watermark, for example.

The security structure 10 may also be in the form of a patch, as shown in FIG. 8, such a patch being designed for example to be stuck onto a face of an article that is to be made secure, in a transparent or translucent region thereof.

The invention is not limited to the examples shown. The reflecting zones of low opacity may for example be made using an interference pigment, e.g. of the flake type based on mica covered in titanium oxide or on glass flakes covered in titanium oxide, and the reflecting zone of higher opacity may be made using an ink, e.g. based on aluminum powder, the two types of pattern being printed in register with each other.

In particular, the shape of the security structure may be modified and the first and second regions of different opacities may be made differently.

The security structure may be applied to articles other than papers, for example packaging, a packaging device, a blister pack for medication, an optical disk, . . . .

The term "comprising a" should be understood as being synonymous with "comprising at least one" unless specified to the contrary.

The invention claimed is:

1. A security structure comprising:

a first region that is at least partially reflective and of low opacity;

a second region that is at least partially reflective and of higher opacity than the first region;

a layer of a coating presenting birefringence properties, covering the first and second regions, at least in part; and a front face, wherein the first and second regions are arranged such that the first and second regions are juxtaposed along the front face of the security structure.

2. A structure according to claim 1, the coating including nematic liquid crystals.

3. A structure according to claim 1, the first region of low opacity being semi-reflective.

4. A structure according to claim 1, the second region of higher opacity being reflective.

5. A structure according to claim 1, the first and second regions being obtained by depositing varying thicknesses of a metal.

6. A structure according to claim 5, the metal being aluminum.

7. A structure according to claim 1, the first region being obtained by depositing an interference pigment.

8. A structure according to claim 1, the first region including a layer presenting a large difference of refractive index relative to an associated medium.

9. A structure according to claim 1, the first region presenting a reflective characteristic that depends on the angle of observation.

10. A structure according to claim 1, the second region completely surrounding the first region.

11. A structure according to claim 1, the first region defining patterns that repeat at regular intervals.

12. A structure according to claim 1, including, in the second region, a deposit of a first material, and in the first region, a deposit of a second material.

13. A structure according to claim 1, the coating including printing nematic liquid crystals in the form of at least one pattern.

14. A structure according to claim 1, the coating layer presenting birefringence properties that define patterns that repeat on the structure.

15. A structure according to claim 1, the difference in opacity between the region of low opacity and the region of higher opacity lying in the range of 5 to 80 (standard: ISO 2471).

16. An article selected from a document, packaging, a packaging device, in particular a blister pack for medication, or an optical disk, the article incorporating a security structure as defined in claim 1.

17. An article according to claim 16, the security structure forming a security thread that extends from one side to the other of the article.

18. An article according to claim 16, the article including a fiber substrate.

19. A method of authenticating a security structure as defined in claim 1, the method comprising:

observing the structure in reflection, in non-polarized light, the observation being performed without a polarizing filter, presenting linear or circular polarization; and observing the structure in reflection through a polarizing filter.

20. A method according to claim 19, further comprising observing the structure in transmitted light.

* * * * *